United States Patent [19]

Mahan

[11] Patent Number: 4,523,387

[45] Date of Patent: Jun. 18, 1985

[54] MICROWAVE TREATING MECHANISM

[76] Inventor: Douglas P. Mahan, 4300 SW. 188th Ave., Aloha, Oreg. 97007

[21] Appl. No.: 559,497

[22] Filed: Dec. 8, 1983

[51] Int. Cl.[3] ..... F26B 23/08

[52] U.S. Cl. ..... 34/1; 34/4; 34/133; 219/10.55 R; 219/10.55 D

[58] Field of Search ..... 34/1, 4, 133, 48; 219/10.55 R, 10.55 A, 10.55 D, 10.55 E

[56] References Cited

U.S. PATENT DOCUMENTS 4,330,696 5/1982 Pomeroy et al. ..... 219/10.55 E 4,356,640 11/1982 Jansson ..... 34/1

4,430,806 2/1984 Hopkins ..... 219/10.55 D

*Primary Examiner*—Larry I. Schwartz

*Attorney, Agent, or Firm*—Eugene M. Eckelman

[57] ABSTRACT

A housing encloses a tumbler-type microwave opaque drum operating on a horizontal axis. A microwave power supply is mounted on the housing with the output directed axially into the drum. The drum has an inner coating or layer of microwave insulating material to reduce arcing of microwave energy between the drum and metal articles tumbling therein. A rear portion of the drum has a microwave-transparent perforated wall supported therein which keeps tumbling articles out of the near field of the output of the power means. The drum and the housing have an overlapping microwave seal therebetween to maintain the microwave energy efficiently in the drum. A forced air arrangement is provided for circulating air through the drum and also to pick up heat from the power supply to increase the vapor carrying capabilities of the forced air and to cool the power supply.

5 Claims, 3 Drawing Figures

MICROWAVE TREATING MECHANISM

BACKGROUND OF THE INVENTION

This invention relates to new and useful improvements in microwave treating mechanisms and has particular use as a clothes dryer of the tumbling drum type.

SUMMARY OF THE INVENTION

According to the present invention and forming a primary objective thereof, an improved microwave treating mechanism is provided employing a novel microwave-opaque drum construction which eliminates undesirable arcing of microwave energy between the drum and metal articles tumbling therein and more particularly provides a microwave energy insulating coating or layer on the inner surface of the drum to fully or partially insulate the drum from such articles.

Another object is to provide a microwave treating mechanism with a tumbling type drum having a perforated microwave-transparent wall secured therein which is spaced from the output of the microwave power means to keep tumbling articles out of the near field of such output.

Another object is to provide a microwave treating mechanism of the type described employing novel microwave energy sealing means between the rotating drum and the housing to prevent leakage of microwave energy from the drum into surrounding areas of the housing.

In carrying out the objectives of the invention, a housing supports a hollow tumbler-type microwave-opaque drum having an inner cavity arranged to receive articles from which moisture is to be removed. The drum is supported and driven on essentially a horizontal axis to tumble the articles, and microwave power means are disposed with the output thereof directed axially into the drum for engaging the tumbling articles. A microwave energy insulating layer is provided on the inner surface of the drum cavity to reduce arcing of energy between metal objects in the cavity and the opaque drum. The drum has a rear wall of microwave-transparent material spaced from the output of the microwave power means to keep tumbling articles out of the near field of the power means. This rear wall is perforated to allow for the circulation of air through the drum. Such circulation is provided by two sources one of which is independent of the microwave power means and the other of which cools the microwave power means and utilizes the heat generated by the said power means to increase the vapor carrying capabilities of the forced air. Novel sealing means are provided between the drum and the housing to maintain the microwave energy within the drum in an efficient manner.

An additional object comprises the provision of a novel forced air heating system for drying articles as well as for circulating air and carrying away moisture and for cooling the microwave power means.

The invention will be better understood and additional objects and advantages will become apparent from the following description taken in connection with the accompanying drawings.

DETAILED DESCRIPTION OF A PREFERRED EMBODIMENT

Figure 3:
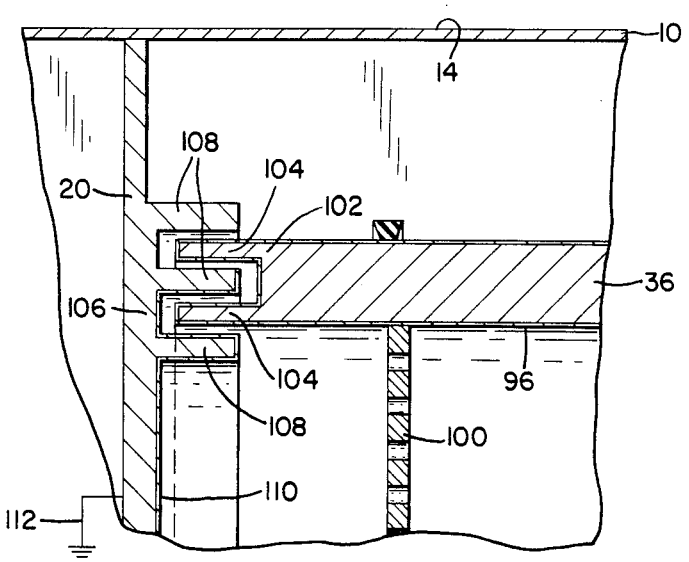
FIG. 3 is a detailed view of sealing means between the drum and the housing, this view being taken on the line 3—3 of FIG. 1.
Figure 1:
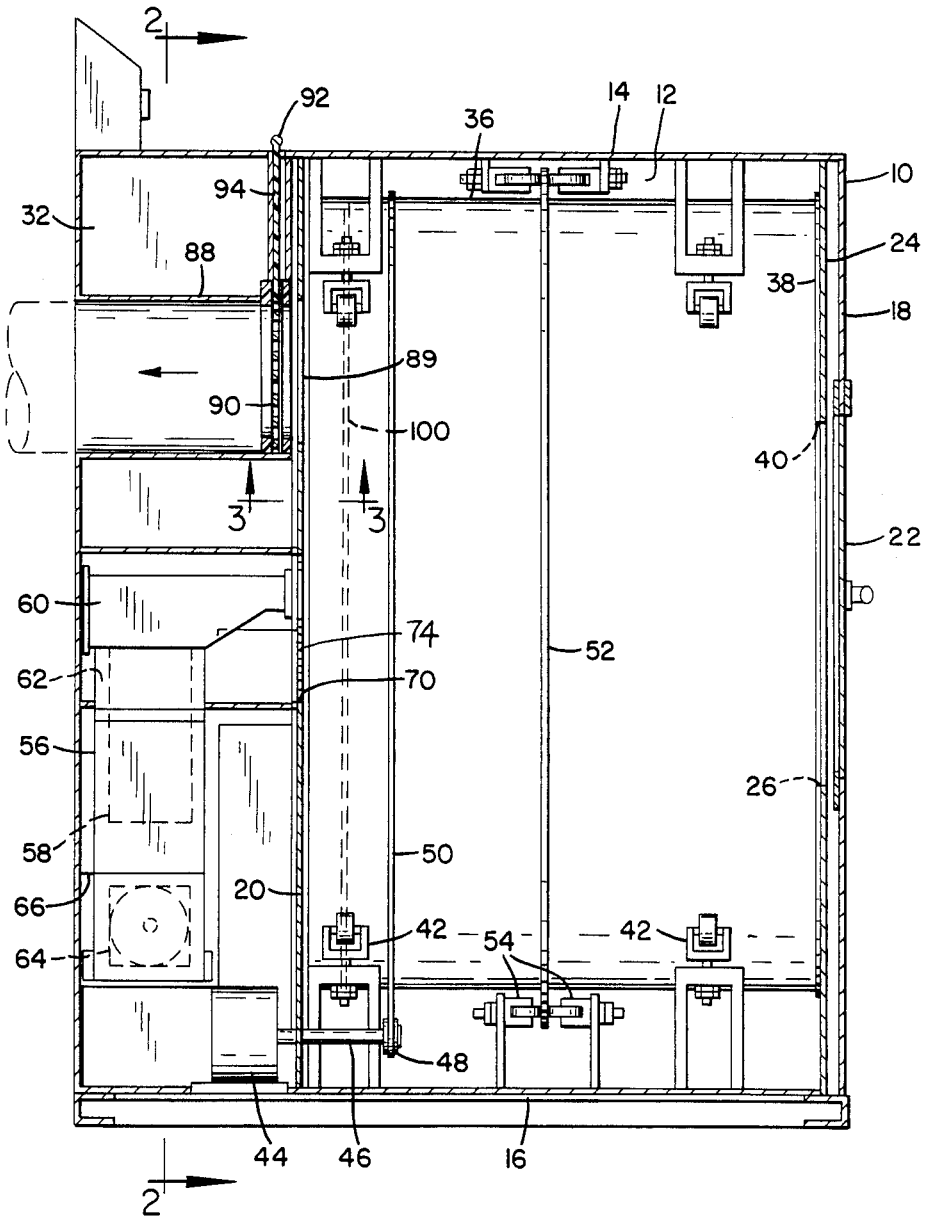
FIG. 1 is a vertical sectional view through a microwave treating mechanism embodying features of the present invention.
Figure 2:
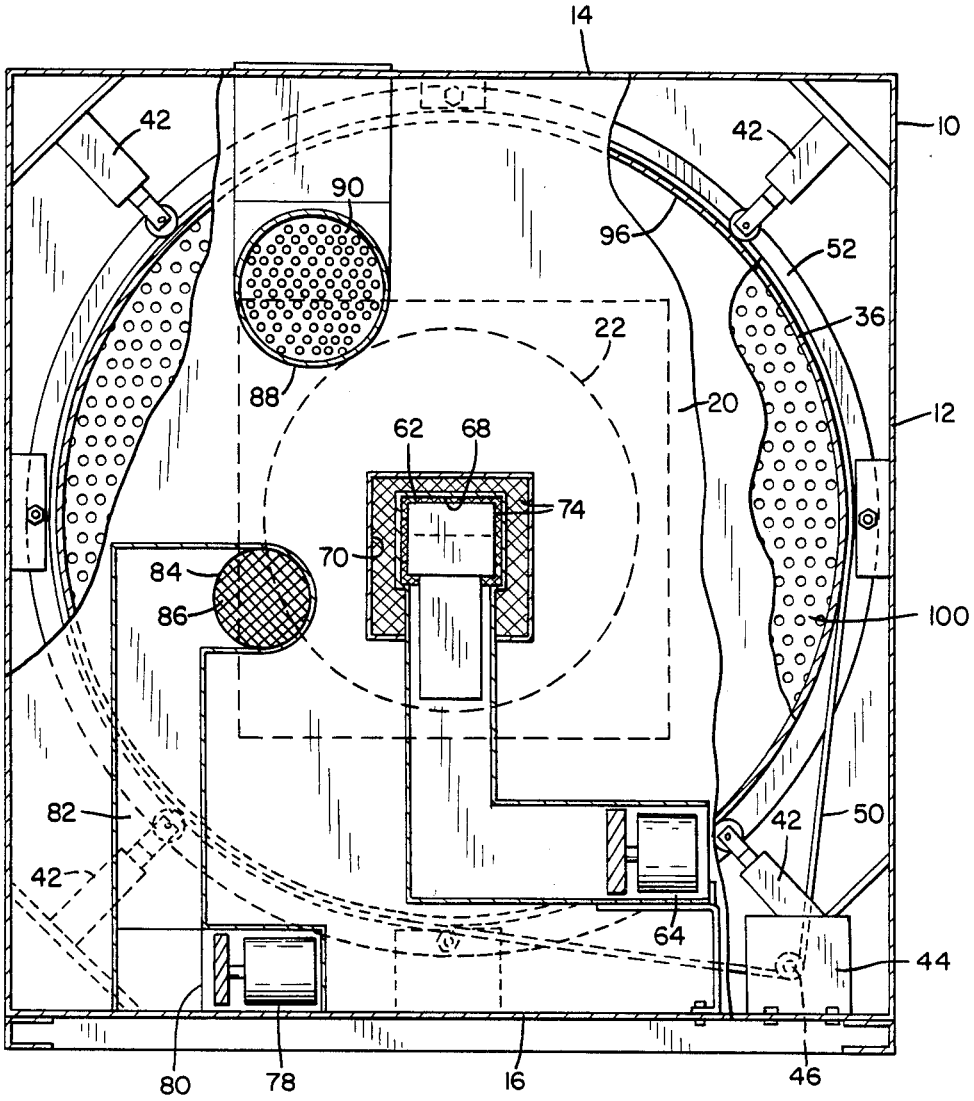
FIG. 2 is a rear sectional view taken on the line 2—2 of FIG. 1.

With particular reference to the drawings, a housing 10 is provided having side walls 12, a top wall 14, a bottom wall 16, a front wall 18, and a rear wall 20. Front wall 18 has a hinged door 22 or other suitable means of access. An auxiliary wall 24 is spaced rearwardly from the front wall 18 and has an opening 26 in alignment with the door 22. The housing 10 has a rear compartment 32 behind the wall 20.

A tumbler-type drum 36 is disposed within the housing. This drum has a partial front wall 38 with an opening 40 aligned with the opening 26 in the housing and with the door 22. The rear of the drum is open. The drum has front and rear rotative support on a plurality of bearing mounted rollers 42 mounted at various points around the housing. Rotative drive for the drum comprises a drive unit 44, such as an electric motor, having an output shaft 46 provided with a pulley 48 which drives a belt 50 engaged with the peripheral surface of the drum. The drum is stabilized from front to rear by a peripheral flange 52 riding between two or more opposed guide roller assemblies 54 secured to the housing.

An auxiliary housing 56 is secured in the rear compartment 32 and encloses microwave power means such as a magnetron 58 having an output or wave guide portion 60. Housing 56 is somewhat larger than the magnetron power means and the latter is mounted in spaced relation from the inner walls thereof so as to form spaces 62 around the power means whereby forced air from a blower unit 64, with an inlet 66 at the bottom of the housing 56, will cause air to circulate around the power means. The output 60 of the power means communicates with an opening 68 in the rear wall 20, and this wall also has an outlet opening 70 therebelow through which the forced air from the blower unit 64 is discharged into the drum. Openings 68 and 70 are covered by screen 74.

Forced air from the blower unit 64 maintains the power unit 58 in a cooled operating condition, and at the same time the heat that is picked up from such power means is transferred into the rotating drum to assist in carrying away moisture in the drum. No other heat is added. Additional air circulation is provided by a second blower unit 78 in the rear compartment 32 and offset from the power means. Blower unit 78 has an inlet 80 for room air and is in communication with a duct 82 discharging into the drum through an aperture 84 in the rear wall 20. Aperture 84 has a screen covering 86. The combination of the two circulating blowers provides good moisture removal from the drum.

The rear compartment 32 has an outlet duct 88 adjacent the upper end thereof communicating with an apertured portion 89 in the wall 20 approximately the area of the cross section dimension of the duct 88. Duct 88 leads to the exterior of the housing. A lint screen member 90 is supported across the duct 88 in a slidable fit by a guide slot 92. It has a handle 94 projecting upwardly beyond the top of the housing by means of which the lint screen 90 may be removed and cleaned. It is preferred that the apertures 90 comprise perforations rather than a screening type opening since it is found that perforations of one eighth inch or less prevents leakage of microwave energy and at the same time provides a good outlet of air without plugging up with lint.

The drum has a wall or baffle 100 therein spaced a short distance forward from the rear wall 20. This wall is perforated to allow the circulation of air through it. Also, it is constructed of microwave-transparent material so as not to interfere with movement of microwave energy. This wall protects the microwave output 60 physically from tumbling articles in the drum. It also serves to space the tumbling articles from the output so as to keep objects a minimum wave length distance away from the output and thus out of the coupler's near field. This prevents perturbations of the near field by articles in the dryer from providing increases in the average reflected power or voltage standing wave ratio which may be damaging to the microwave power means.

The surfaces of the drum 36, and particularly the inner surface, are microwave insulating coating or layer 96. This layer dulls the tips of the microwave energy and causes them to bounce in the microwave opaque drum without arcing.

Microwave energy sealing means are provided between the drum 36 and the housing 10 at the ends thereof to prevent leakage of microwave energy into housing portions which surround the drum. For this purpose, and with particular reference to FIG. 3, the drum has a bifurcated projection 102 at each end which extends fully around the drum adjacent the outer peripheral surface thereof. For this purpose, the projection 102 at the rear comprises an extension of the rear edge of the drum and at the front such projection comprises a ring-like extension at the front corner. The legs 104 of these bifurcated projections thread freely into a double bifurcated projection 106 secured to the housing 10 also in ring form. Legs 108 of bifurcations 106 overlap the legs 104 whereby the seal between the drum comprises the zig-zag space between these two members.

The inner surface coating 96 of the drum extends around these legs, or at least around the first leg. The portion of the rear wall 20 disposed radially inwardly of the drum also has a coating 110 of microwave energy insulating material. This coating extends around a first leg 108 adjacent the interior of the drum and around a portion of the next leg 108. By this arrangement, microwave energy leakage is prevented by the overlapping coated leg portions and such energy does not escape to the housing. The housing is electrically grounded, as illustrated diagrammatically at 112, and any of the microwave energy that may possibly leak through the coated portion of the seal will be grounded and thus stopped.

The present invention provides a simplified microwave treating mechanism which is highly efficient in its operation. The rear mount of the power means does not interfere with loading and unloading of the drum. The air which circulates through the drum not only cools the magnetron and other associated parts but since the air moving over the magnetron is heated, it has increased vapor carrying capabilities to efficiently remove moisture from the articles being treated and from the drum. Wall 100 actively protects the output of the magnetron from tumbling articles, and particularly metal articles, and also allows for the desired circulation of air. The seal between the drum and the housing, as shown in FIG. 3, also adds to efficiency of the treating mechanism in making full use of the microwave energy without loss.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Microwave treating mechanism for removing moisture from articles comprising a housing including front and rear walls, a hollow tumbler-type microwave opaque drum having front and rear ends and also having an inner cavity arranged to receive articles from which moisture is to be removed, said housing and drum having an opening for loading and unloading articles, support means supporting said drum on substantially a horizontal axis, drive means arranged to rotate said drum whereby articles being treated tumble laterally across the interior of said drum, microwave power means disposed with the output thereof directed axially through said drum into said cavity for engaging articles tumbling laterally across said rotating drum for removing moisture therefrom, a microwave energy insulating layer on the inner surface of said cavity arranged to allow reflection of microwave energy waves from said opaque drum but reducing arcing of said energy waves between metal objects tumbling in said cavity and said opaque drum, an electric circuit for said power means, and control means in said circuit for said power means.

2. The microwave treating mechanism of claim 1 wherein said microwave power means is directed axially through the rear end of said drum.

3. Microwave treating mechanism for removing moisture from articles comprising a housing including front and rear walls, a hollow tumbler-type microwave opaque drum having front and rear ends and also having an inner cavity arranged to receive articles from which moisture is to be removed, said housing and drum having an opening for loading and unloading articles, support means supporting said drum on substantially a horizontal axis, drive means arranged to rotate said drum whereby articles being treated tumble laterally across the interior of said drum, microwave power means disposed with the output thereof directed axially through said drum into said cavity for engaging articles tumbling laterally across said rotating drum for removing moisture therefrom, a baffle of microwave transparent material in said drum spaced from said microwave power means arranged to keep tumbling articles out of the near field of the output of said power means, an electric circuit for said power means, and control means in said circuit for said power means.

4. The microwave treating mechanism of claim 3 wherein said baffle is perforated to allow for the circulation of air through said drum from one end to the other.

5. Microwave treating mechanism for removing moisture from articles comprising a housing including front and rear walls, a hollow tumbler-type microwave opaque drum having front and rear ends and also having an inner cavity arranged to receive articles from which moisture is to be removed, said housing and drum having an opening for loading and unloading articles, support means supporting said drum on substantially a horizontal axis, drive means arranged to rotate said drum whereby articles being treated tumble laterally across the interior of said drum, microwave power means disposed with the output thereof directed axially through said drum into said cavity for engaging articles tumbling laterally across said rotating drum for removing moisture therefrom, the ends of said drum having openings therein and said ends being disposed adjacent to front and rear walls of said housing, the inner surface of said front and rear walls having a microwave insulating layer thereon, microwave energy sealing means at the ends of said drum sealing said drum from an area between said housing and said drum, said sealing means comprising overlapping extension means on said drum and housing, a portion of the overlapping extension means of said housing being bare of said microwave insulating layer, an electric circuit for said power means, an electrical ground connected to said housing to ground microwave energy reaching said bare portion of said sealing means, and control means in said circuit for said power means.

* * * * *